US008063333B2

(12) United States Patent
Rostron et al.

(10) Patent No.: US 8,063,333 B2
(45) Date of Patent: Nov. 22, 2011

(54) LIMITED FLASH-OVER ELECTRIC POWER SWITCH

(75) Inventors: Joseph R. Rostron, McDonough, GA (US); Bradley J. Schafer, Hampton, GA (US); Soung Hwan Lyu, McDonough, GA (US); Brian Roberts, Atlanta, GA (US); Richard Burge, Atlanta, GA (US)

(73) Assignee: Southern States, Inc., Hampton, GA (US)

( * ) Notice: Subject to any disclaimer, the term of this patent is extended or adjusted under 35 U.S.C. 154(b) by 479 days.

(21) Appl. No.: 12/366,531

(22) Filed: Feb. 5, 2009

(65) Prior Publication Data

US 2010/0193474 A1 Aug. 5, 2010

Related U.S. Application Data

(60) Provisional application No. 61/026,217, filed on Feb. 5, 2008.

(51) Int. Cl.
*H01H 33/88* (2006.01)

(52) U.S. Cl. ..... 218/66; 218/57; 218/76

(58) Field of Classification Search ..... 218/57, 218/66, 76
See application file for complete search history.

(56) References Cited

U.S. PATENT DOCUMENTS

| | | | | |
|---|---|---|---|---|
| 4,046,978 | A * | 9/1977 | Badon | 218/65 |
| 4,389,554 | A * | 6/1983 | Freeman | 218/57 |
| 4,420,662 | A * | 12/1983 | Niemeyer et al. | 218/53 |
| 5,850,065 | A * | 12/1998 | Yaginuma et al. | 218/76 |
| 6,744,001 | B2 * | 6/2004 | Dufournet et al. | 218/66 |

* cited by examiner

*Primary Examiner* — Truc Nguyen
(74) *Attorney, Agent, or Firm* — Michael J. Mehrman; Mehrman Law Office P.C.

(57) ABSTRACT

A limited flash-over electric power switch uses a dielectric gas regulator and a flash-over arrestor to greatly diminish the occurrences of high voltage flash-over during operation of a circuit interrupter. The dielectric gas regulator prevents the flow of the dielectric gas into the arc gap during an initial portion of the opening stroke of the interrupter contacts. Once the arc gap is sufficiently wide to greatly diminish the likelihood of a high voltage flash-over, the dielectric gas regulator allows the dielectric gas to flow into the arc gap to extinguish the arc. The flash-over arrestor snubs out incipient flash-over that may occur as the arc attempts to reform across the arc gap. The flash-over arrestor may be a conductive ring located on the interior surface of the nozzle in the region of the orifice.

9 Claims, 15 Drawing Sheets

LIMITED FLASH-OVER ELECTRIC POWER SWITCH

REFERENCE TO PRIORITY APPLICATIONS

This application claims priority to commonly-owned U.S. Provisional Patent Application No. 61/026,217 filed Feb. 5, 2008, which is incorporated herein by reference.

REFERENCE TO DISCLOSURES INCORPORATED BY REFERENCE

This application incorporates by reference the disclosures of commonly-owned U.S. Pat. Nos. 7,115,828; 7,078,643; 6,583,978; 6,483,679; 6,316,742 and 6,236,010 and commonly-owned U.S. application Ser. No. 11/944,111.

TECHNICAL FIELD

The present invention relates to electric switchgear and, more particularly, relates to a limited flash-over electric power switch suitable for use as a reactor, capacitor, load or line switch on distribution and transmission circuits up to high voltage and extra high voltage levels.

BACKGROUND OF THE INVENTION

It is common to switch reactors into and out of transmission circuits on electric power systems. Reactors are principally used as voltage regulators for long transmission lines, such as high voltage and extra high voltage transmission lines, during low load periods. Additional uses are for load flow control, fault current limiting, and filtering. When used as a voltage regulator, a reactor is typically switched into and out of an electric power transmission circuit on a daily basis, typically every night when the loads are low, which is a significantly higher switching frequency than experienced by fault clearing switches, such as circuit breakers and sectionalizing switches. A device known as a circuit interrupter (also called a switcher) is used to switch reactors, capacitors and various types of loads into and out of their associated electric power circuits. Many types of circuit interrupters have been developed with unique design characteristics for specific electrical applications, voltage and current levels. Example circuit interrupters are described in commonly-owned U.S. Pat. Nos. 7,115,828; 7,078,643; 6,583,978; 6,483,679; 6,316,742 and 6,236,010 and U.S. application Ser. No. 11/944,111, which are incorporated by reference.

A challenging voltage regulation application, and an important application for the present invention, is reactor switching at high voltage and extra high voltage transmission levels. In these applications, current reignitions across the arc gap in the circuit interrupter cause very steep voltage increases in the reactor between turns. This electrical stress caused by reignition during reactor switching is similar to that caused by lightning only that it occurs much more frequently. That is, reactor switching typically occurs on a daily basis, whereas lightning typically occurs much less frequently, such as a yearly basis in general. The daily operation and frequent reignitions during reactor switching cause cumulative damage to reactors that reduce the life of these expensive devices. Frequent reignitions can also cause damage to the interrupter by puncturing the nozzle materials, usually Teflon®, which in turn increases the likelihood of further reignitions. Also, the strong pressure developed in interrupters can force the current to zero prematurely, which further increases the voltage on the reactor thus requiring the interrupter to withstand even higher voltages. It is therefore important to switch the reactors in a manner that minimizes damages caused to the reactors, the interrupters, and other electric system components, from reignitions occurring during the switching process.

Switching of capacitor banks is also a common occurrence in electric power systems. The inductive reactance of motors in home and industrial use cause less than unity power factors, which if uncorrected can increase system losses and cause voltage levels delivered to end-use customers to drop to unacceptable levels. Capacitor banks are usually switched into the electric power circuits during high levels of inductive loading, typically during the daylight and early evening hours when most people are awake and using electric power, to correct the power factor, reduce delivery losses, and boost the voltage to the end-use customers. Once the high level inductive loading subside, typically at night, the capacitor banks are switched out of the electric power circuit. Daily cyclical use of capacitors is therefore a common practice to balance the capacitive reactance with inductive loads, and thus minimizing the stated problem, as electric loads increase and decrease on a daily basis.

Because inductive residential loads typically increase and decrease on a daily cycle, capacitor switching in response to residential loads typically occurs on a daily basis. Capacitor switching can also occur multiple times daily, for example when residential loads are combined with industrial or municipal loads that occur at night or multiple times per day. Coal mining equipment, aluminum smelters, manufacturing assembly lines, municipal water pumps, and electric transportation loads, to name but a few examples, can place large, cyclical or intermittent inductive loads on an electric power system. As a result, capacitor switches often experience several hundred to several thousand operations per year. Circuit breakers that are designed to operate in response to overload and other emergency conditions, by comparison, typically operate much less frequently, on the order of only a few isolated operations up to a couple of dozen times per year.

Switching a capacitor bank out of an electric power circuit can cause a restrike to occur across the arc gap inside the circuit interrupter, which can cause system disturbances and damage to the capacitor bank, the circuit interrupter, and other electric system components. Restrikes during capacitor switching are similar to reignitions during reactor switching in that they both involve high voltage causing a flash-over across the arc gap between the contacts of the interrupter after the arc has been initially extinguished at a current zero-crossing. Flash-over can also occur when switching loads, lines and other types of electrical components that have significant inductive or capacitive components. Because the voltage in an electric power system is alternating, the current extinguished periodically at each current zero-crossing and the voltage periodically builds to its peak magnitude each half cycle, the voltage tends to cause a flash-over as the voltage approaches its maximum magnitude each half cycle. Each time the current flashes over as the arc gap widens on the opening stroke, the flash-over occurs as a higher voltage. A flash-over occurring across a relatively high voltage across a relatively wide contactor gap during an opening stroke of the interrupter can damage the interrupter, damage the switched device, and cause an undesirable disturbance on the electric power circuit.

A need therefore exists for circuit interrupters for reactor, capacitor, load and line switching at distribution and transmission voltages up to high voltage and extra high voltage levels that that minimizes damages caused to electric system components from flash-over across the interrupter arc gap during the switching process. In particular, because reactors used for voltage regulation are operated relatively frequently and at high transmission voltages, it is important to switch the reactors in a manner that minimizes damages caused to the reactors and the circuit interrupters from flash-over during the switching process. There is, therefore, a continuing need for a circuit interrupter suitable for switching reactors on high voltage and extra high voltage transmission lines to extend the life of the reactors and the reactor switching circuit interrupters by minimizing the frequency of high voltage flash-over that can causes damage and life reduction.

SUMMARY OF THE INVENTION

The present invention meets the needs described above in a limited flash-over electric power switch suitable for reactor, capacitor, load and line switching at distribution and transmission voltages up to high voltage and extra high voltage levels that that minimizes damages caused to electric system components from flash-over during the switching process. The limited flash-over electric power switch includes a circuit interrupter that is designed to serve as a reactive load switcher ("RL switcher") for connecting reactors into and out of high voltage and extra high voltage transmission circuits to extend the life of the reactors and reactor switching circuit interrupters by minimizing the frequency of high magnitude flash-over that can causes damage and life reduction. Although the limited flash-over electric power switch is well suited for reactor switching at high voltage and extra high voltage transmission levels, it can also be used for capacitor, load and line switching at any desired electric power voltage level.

The limited flash-over electric power switch uses a dielectric gas regulator and a flash-over arrestor to greatly diminish the occurrences of high voltage flash-over during operation of the circuit interrupter. The dielectric gas regulator prevents the flow of the dielectric gas into the arc gap during an initial portion of the opening stroke of the interrupter contacts. Once the arc gap is sufficiently wide to greatly diminish the likelihood of a high voltage flash-over, the dielectric gas regulator allows the dielectric gas to flow into the arc gap to extinguish the arc. The flash-over arrestor snubs out incipient flash-over that may occur as the arc attempts to reform across the arc gap. The flash-over arrestor may be a conductive ring located on the interior surface of the nozzle in the region of the orifice.

Generally described, the invention may be practiced in an electric power switch, a circuit interrupter for an electric power switch, or in a nozzle for a circuit interrupter. The circuit interrupter includes a sealed chamber containing a dielectric gas. The circuit interrupter also includes a contactor located within the chamber having first and second contacts movable in relation to each other during an opening stroke from a closed position in which the contacts are electrically connected to close the electric power circuit to an open position in which the contacts are electrically separated to open the electric power circuit. A drive mechanism operates to move the contacts through the opening stroke and create a flow of the dielectric gas within the chamber to open the electric power circuit. The contacts are configured to form an arc extending in an arc gap direction across an arc gap between the contacts during the opening stroke. A nozzle, which is configured to direct the flow of the dielectric gas into the arc gap to extinguish the arc during the opening stroke, includes an arc extending zone in fluid communication with an arc extinguishing zone. A dielectric gas regulator restricts the flow of the dielectric gas into the arc gap during a first portion of the opening stroke to cause the arc gap to extend across the arc extending zone. The dielectric gas regulator then opens the flow of the dielectric gas into the arc gap during a second portion of the opening stroke to initially extinguish the arc after the arc has extended into the arc extinguishing zone. The arc extending zone has a sufficient length in the arc gap direction to prevent the arc from flashing over across the arc gap between the contacts after the arc has been initially extinguished.

More specifically, the nozzle may include an orifice for controlling the flow of the dielectric gas into the arc gap, and the circuit interrupter may include a shaft movable into and out of the orifice. In this case, the dielectric gas regulator is formed by the shaft being received within the orifice during the first portion of the opening stroke and the shaft being removed from the orifice during the second portion of the opening stroke. Even more particularly, the first contactor may include or form the shaft, which defines an end that moves through the orifice during the opening stroke. In addition, the arc extinguishing zone may include the orifice. For this embodiment, during the opening stroke, the end of the first contact moves relative to the second contact and the nozzle from a first position in physical contact with the second contact, then through the arc extending zone, then through the orifice which forms a first part of the arc extinguishing zone, and then through the arc extinguishing zone. As a result, the first contact substantially restricts the flow of the dielectric gas into the arc gap until the end of the first contact moves through the orifice, at which point the arc extends between the first and second contacts through the arc extending zone until the end of the first contact moves through the orifice. The end of the first contact moving through the orifice then allows the dielectric gas to flow into the arc gap to extinguish the arc. The contactor may be a penetrating-type contactor, the first contact may define a male contact that is fixed with relation to the chamber, and the second contact may define a female contact that is movable with relation to the chamber. In this case, the nozzle is fixed in relation to the female contact and moves along with the female contact.

The circuit interrupter may also include a flash-over arrestor configured to snub out incipient flash-over after the arc has been initially extinguished. The flash-over arrestor typically includes a conductive ring located in the nozzle having a portion of the conductive ring exposed to an interior volume of the nozzle, which may be located in the orifice of the nozzle.

In view of the foregoing, it will be appreciated that the present invention provides a cost effective limited flash-over electric power switch suitable for use as a reactor, capacitor, load or line switch. The specific techniques and structures for implementing particular embodiments of the invention, and thereby accomplishing the advantages described above, will become apparent from the following detailed description of the embodiments and the appended drawings and claims.

DETAILED DESCRIPTION OF THE EMBODIMENTS

Figure 1:
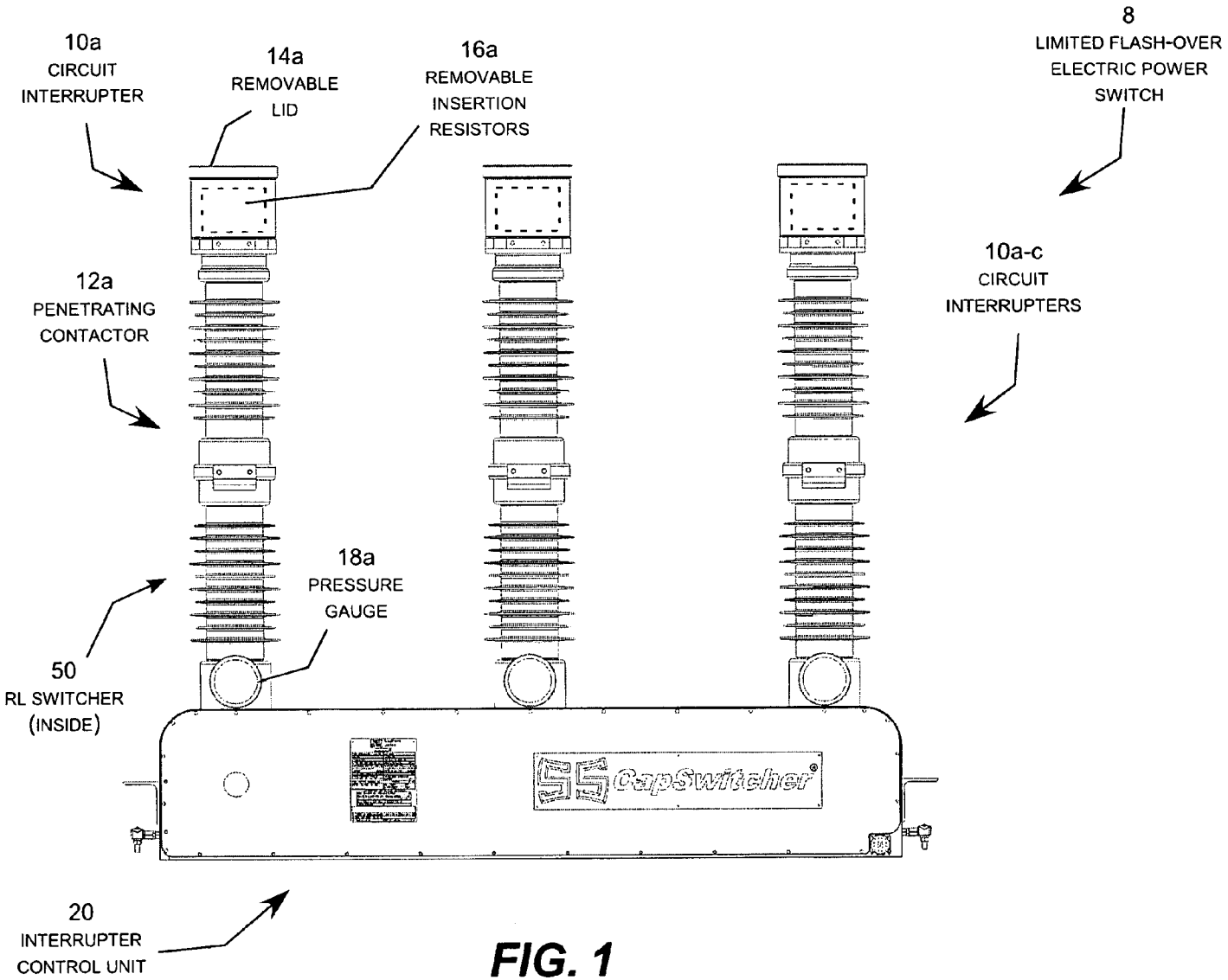
FIG. 1 is a front view of a three phase limited flash-over electric power switch.

The present invention may be embodied in a limited flash-over electric power switch for connecting and disconnecting an electric service component to an electric power circuit at distribution and transmission voltages. Although the switch is specifically designed to operate as a reactor switch, it may also be used as a capacitor, line or load switch. The switch typically includes a circuit interrupter for each electric line to be switched, typically one per phase of a three-phase electric power circuit. Within the circuit interrupter, spring-driven acceleration mechanisms are typically used to accelerate penetrating contactors to sufficient velocity to extinguish an arc occurring across an arc gap without experiencing an undesirable high voltage flash-over across the arc gap. This type of flash-over is typically referred to as a "reignition" when it occurs during inductive load switching (e.g., reactor switching) and a "restrike" when it occurs during capacitive load switching (e.g., capacitor bank switching). The limited flash-over electric power switch greatly reduces the occurrence of both types of high voltage flash-over, and is therefore suitable for use as a reactor, capacitor, line or load switch.

Avoiding a high voltage flash-over during an electric power switching operation in the conventional manner requires extinguishing the arc that forms between the interrupter contacts after one-half cycle, which prevents a flash-over from occurring after the initial arc break that occurs at the first half-cycle zero voltage crossing after initial separation of the contacts. To help extinguish the arc, a penetrating contactor with a movable (typically female) contact that separates from a fixed (typically male) contact is housed within a sealed container filled with a dielectric gas, such as sulphur hexafluoride ($SF_6$). The circuit interrupter directs a flow of the dielectric gas through a nozzle into the arc gap formed by the separating contacts to extinguish the arc as the penetrating contactor opens. Because the dielectric gas ionizes to absorb the energy of the arc, a brisk flow of the dielectric gas into the arc gap greatly increases the breakdown voltage in the arc gap, thereby increasing the ability of the interrupter to extinguish the arc.

As a result of the properties of the dielectric gas, the length of the arc gap required to prevent a flash-over across the arc gap is much higher in the absence of a flow of the dielectric gas than it is in the presence of a flow of the dielectric gas. The limited flash-over electric power switch uses this difference to greatly diminish the occurrences of high voltage flash-over though the use of a dielectric gas regulator that prevents the flow of the dielectric gas into the arc gap during an initial portion of the opening stroke of the interrupter contacts. Once the arc gap is sufficiently wide to greatly diminish the likelihood of a high voltage flash-over, the dielectric gas regulator allows the dielectric gas to flow into the arc gap to extinguish the arc. Using a dielectric gas regulator to delay the introduction of dielectric gas into the arc gap to prevent a high voltage flash-over is a new and highly effective technique not previously incorporated into circuit interrupter design.

Although different types of dielectric gas regulators may be used, a compact, cost effective, and highly effective dielectric gas regulator can be incorporated into the design of the interrupter nozzle, which surrounds the female contact and forms part of the moving contact assembly of the penetrating contactor. In this particular illustrative embodiment, the female contact of the moving contact assembly has a socket shape while the fixed male contact has a rounded shaft or pin shape. To create the dielectric gas regulator, the nozzle includes an arc extending zone, an orifice, and an arc extinguishing zone extending in that order from the end of the female contact to the end of the nozzle. The orifice, which may be elongated to form an extension of the arc extinguishing zone, is sized to match the diameter of the male the contact so that the fit between the orifice and the male contact substantially prevents the dielectric gas from flowing through the nozzle until the orifice clears the end of the male contact. That is, the dielectric gas regulator is formed by the male contact fitting into the orifice of the nozzle and thereby substantially blocking the flow of the dielectric gas until the end of the orifice has cleared the end of the male contact during the opening stroke of the contactor. The fit between the male contact and the orifice of the nozzle should be sufficiently close to substantially block the flow of dielectric gas but not so tight as to form an interference fit, which would introduce friction slowing down the opening of the contactor.

The dielectric gas regulator causes very little gas flow through the nozzle until the arc extending zone and the orifice formed into the nozzle move past the end of the male contact. This maintains and extends the arc between the contacts through the arc extending zone and orifice of the nozzle, into the arc extinguishing zone. Once the orifice of the nozzle has moved past the end of the male contact, the nozzle is opened to allow the dielectric gas to flow through the nozzle and into the arc gap. This allows the dielectric gas to extinguish the arc as the extinguishing zone of the nozzle moves past the end of the male contact. As a result, the arc gap between the male and female contacts is extended the distance of the arc extending zone and the orifice of the nozzle before the dielectric gas is allowed to flow into the arc gap to extinguish the arc. The increased breakdown voltage of the arc gap resulting from the introduction of the dielectric gas only after the arc gap has widened to the distance of the arc extending zone and the orifice greatly diminishes the occurrence of high voltage flash-over across the contacts. As an added benefit, dielectric gas pressure builds up within the nozzle during the initial portion of the movement of the moving contact assembly, which causes an enhanced "puff" of dielectric gas to flow into the arc gap as the nozzle orifice initially clears the end of the male contact, which helps to "blow out" the arc.

To further suppress high voltage flash-over after the flow of dielectric gas has been introduced into the arc gap, the nozzle may include an additional flash-over arrestor that snubs out incipient flash-over that may occur as the arc attempts to reform across the arc gap. The flash-over arrestor is preferably a conductive ring located on the interior surface of the nozzle in the region of the orifice. The conductive ring is exposed to the interior volume of the nozzle, where it intercepts and spreads out an incipient flash-over that is attempting to propagate along the interior nozzle surface. The combination of the dielectric gas regulator and the flash-over arrestor, which can both be incorporated into the nozzle design, greatly reduces the occurrence of high voltage flash-over within the circuit interrupter.

It should be noted that dielectric gas regulator in combination with the drive mechanism that dictates the rate at which the contacts separate may be designed to allow the arc to be maintained between the contacts for multiple current zero-crossings while the dielectric gas is prevented from flowing into the arc gap without causing damage to the contacts or other electric system components. Although the current actually reignites after each current zero-crossing, these reignitions occur at a low voltage that does not cause damage or disturbances to the electric system. This is because the low breakdown voltage caused by the lack of flowing dielectric gas in the arc gap causes the flash-over to occur at a low voltage level while the dielectric gas is prevented from flowing. Once the arc gap is sufficiently wide to prevent a high voltage flash-over in the presence of a flow of the dielectric gas, the gas regulator allows the dielectric gas to flow into the arc gap, which increases the breakdown voltage in the arc gap to a level sufficient to prevent flash-over, to safely extinguish the arc.

The limited flash-over electric power switch may therefore operate to permit one or more low voltage flash-over events to occur following current zero-crossings in the absence of a flow of the dielectric gas in order to prevent a high voltage flash-over event form occurring once the flow of dielectric gas is introduced into the arc gap. Because the limited flash-over electric power switch is designed for switching under normal operating conditions as opposed to fault conditions when switching speed is of paramount importance, this device can safely allow an extra one or two current zero-crossings to occur across the arc gap at the low breakdown voltage that exists without a flow of dielectric gas, in order to gain the benefit of a wider arc gap once the dielectric gas is allowed to begin to flow into the arc gap to extinguish the arc at the much higher breakdown voltage that exists in the presence of the flow of dielectric gas. This aspect of the limited flash-over electric power switch allows this device to use a smaller and less expensive drive unit, thereby providing a much less expensive and more effective approach to avoiding high voltage flash-over in comparison to the conventional approach, which relies on faster and more expensive drive units required to break the arc after a single current zero-crossing in the presence of a flow of the dielectric gas.

In view of the foregoing, it will be understood that with appropriate modifications to provide adequate spacing, lengths and acceleration for the opening and closing strokes, the same basic switch design of the limited flash-over electric power switch can be used all distribution, sub-transmission, and transmission voltages up to high voltage and extra high voltage levels. In practice, the limited flash-over electric power switch will usually include three circuit interrupter switching devices referred to create a three-phase electric power switch. The invention may be deployed in connection with different interrupter designs, including those with different types of drive units. A variety of illustrative interrupter designs are disclosed in commonly-owned U.S. Pat. Nos. 7,115,828, 6,583,978; 6,483,679; 6,316,742 and 6,236,010. All of these patents are incorporated herein by reference.

Figure 2:
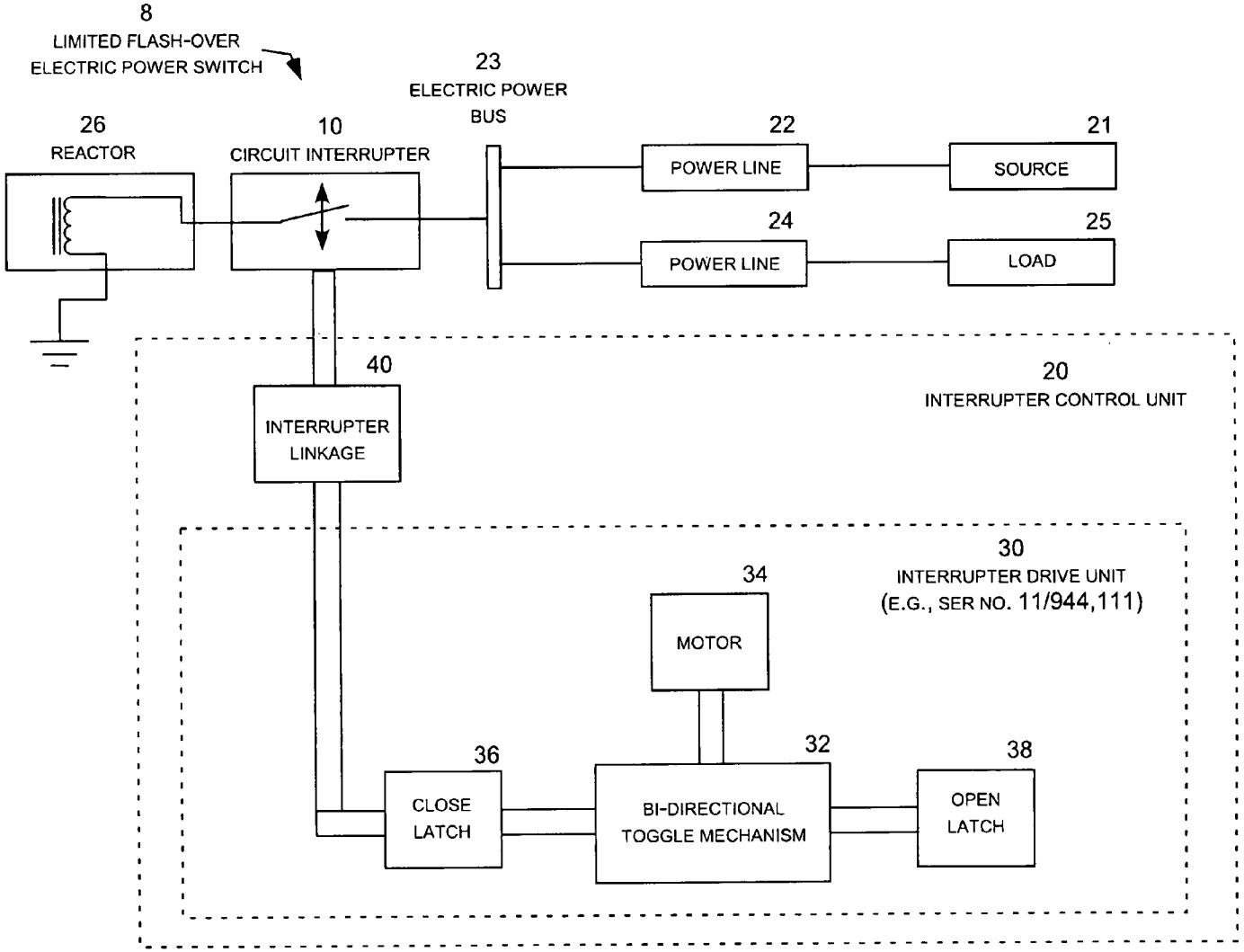
FIG. 2 is a functional block diagram of the limited flash-over electric power switch operated as a reactor switch.
Figure 3:
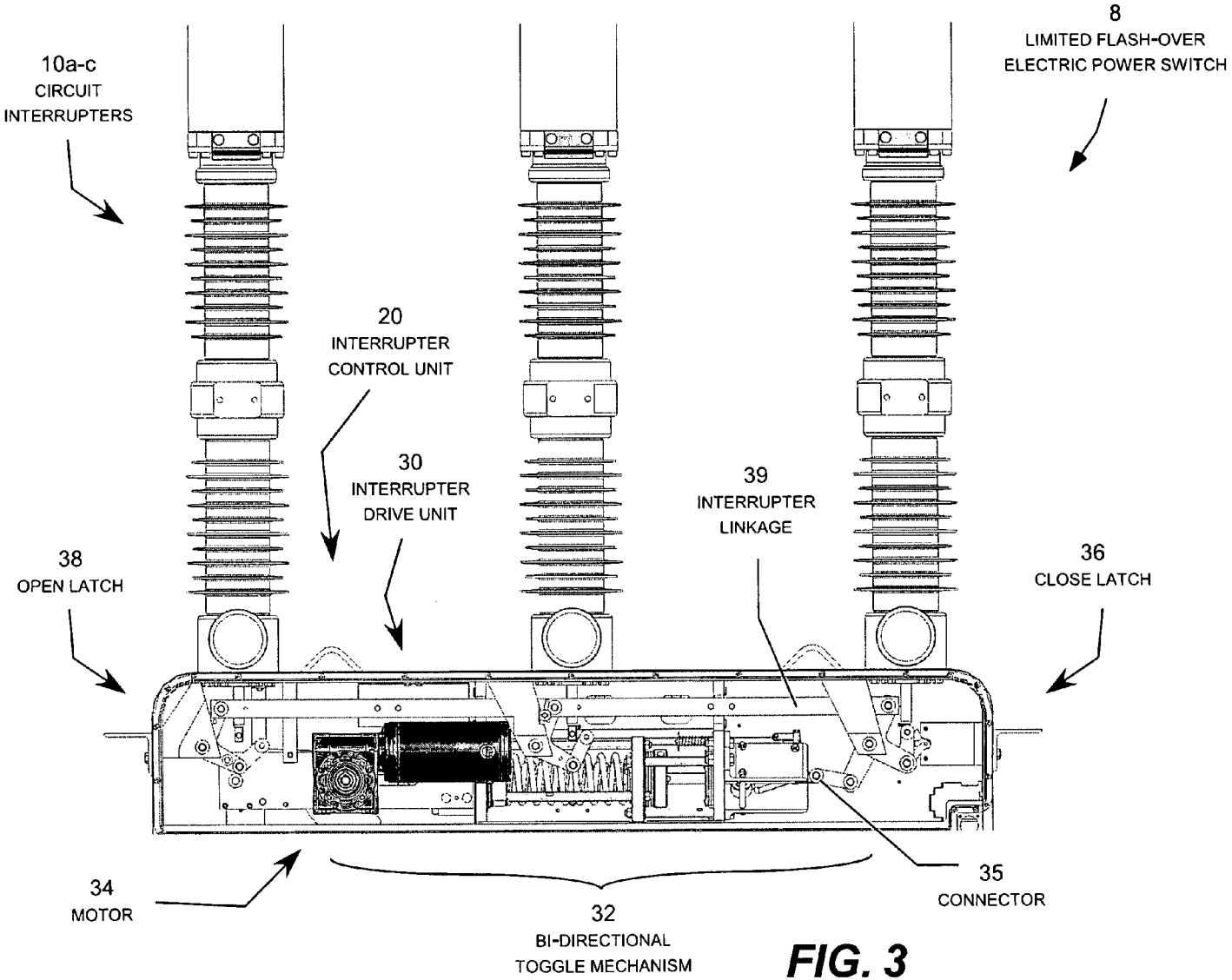
FIG. 3 is a rear view of the limited flash-over electric power switch showing the internal components of the interrupter control unit including an interrupter drive unit and an interrupter linkage.

Turning now to the figures, in which like numerals refer to similar elements throughout the several figures, the specific embodiment of the insulators and drive unit for the limited flash-over electric power switch shown in FIGS. 1-3 is designed to serve as a reactor or capacitor switch for a 38 kV transmission circuit. The specific drive unit shown in FIG. 3 with minor modification can be adapted for use at typical distribution and transmission voltages of 15.5 kV, 25.8 kV, 38 kV, 48.3 kV and 72.5 kV. The interrupter drive unit shown in FIG. 3 for this particular example of the invention is described in detail in U.S. application Ser. No. 11/944,111, which is incorporated by reference. It should be appreciated that the design techniques of the present invention primarily reside in the circuit interrupter, and even more particularly may be incorporated into in the design of the nozzle of the circuit interrupter. Accordingly, the present invention can be implemented with any suitable type of drive unit for any desired number of phases, and can adapted to operate at any desired electric power voltage.

As noted previously, when the specific drive unit shown in FIG. 3 is used to operate a limited flash-over circuit interrupter, more than a single current zero-crossing may be permitted in the absence of a flow of dielectric gas before the dielectric gas regulator introduces the flow of dielectric gas into the arc gap. As a result, the specific drive unit shown in FIG. 3, which is designed to limit a 38 kV switch to a single current zero-crossing without the flash-over limiting technology of the present invention, may be used at higher voltages when used in combination with the flash-over limiting technology of the present invention. Therefore, when used to drive a limited flash-over electric power switch, the drive unit shown in FIG. 3, when used with appropriately sized insulators and circuit interrupters, is suitable for use at higher voltage levels, such as 72.5 kV and 115 kV. With appropriate modifications to provide adequate lengths and acceleration for the opening and closing strokes, the same basic switch design can be use to implement switches for extra high transmission voltages up to 500 kV or higher.

FIG. 1 is a front view of an illustrative three phase electric power switch 8 that includes three circuit interrupters 10*a-c* and an interrupter control unit 20. Referring to an illustrative circuit interrupter 10*a*, this device includes a penetrating contactor 12*a* located within a hollow insulator and a removable lid 14*a* that provides access to a removable insertion resistor 16*a* in an end cap of the interrupter. The basic structure and operation of the penetrating contactor is described in U.S. Pat. Nos. 6,583,978; 6,483,679; 6,316,742 and 6,236,010. The insertion resistor and penetrating contactor are described in greater detail in U.S. Pat. No. 7,078,643 and a prior design for a toggle mechanism is described in U.S. Pat. No. 7,115,828. In summary, the penetrating contactor is located inside the hollow insulator, which is filled with a dielectric gas, typically sulphur hexafluoride ($SF_6$), which helps extinguish electric arcs that occur in the arc gap (also called a spark gap or contactor gap) of the penetrating contactor. This particular circuit interrupter includes a pressure gauge 18*a* that shows the pressure of the dielectric gas inside the insulator. The control unit 20 accelerates the penetrating contactor and temporarily inserts the insertion resistor into the power circuit on the opening and closing strokes of the internal contactor.

More specifically, the control unit 20 accelerates the penetrating contactor, which includes two contactors that move into and out of electrical communication and physical contact during the opening and closing strokes, while forcing the dielectric gas to flow into the gap between the contactors to extinguish the spark that forms in the gap between the contactors as the contactors move into and out of electric connection under high voltage. A reactor, inductive load or capacitor bank in an electric power circuit stores a large electric force, which discharges (at least in part) across the arc gap between the contactors during the opening stroke. The contactor also conducts an arc on the closing stroke as the contactors physically approach each other. The drive unit is therefore designed to accelerate the contactor sufficiently to extinguish the arcs that occur in the arc gap of the contactor on the opening and closing strokes. For circuit interrupters used for reactor, capacitor, line and load switching, the opening stroke is usually more critical than the closing stroke because there is typically less time and travel distance for the contactors to accelerate from the closed position during the opening stroke. Because the breakdown voltage across the contactor gap naturally declines on the closing stroke due to the closing contactor distance, whereas the breakdown voltage naturally increases on the opening stroke as the contactor distance widens, high voltage flash-over is a more significant concern on the opening stroke.

In addition, because the voltage is alternating, the current inherently extinguishes periodically at each current zero-crossing and the voltage periodically builds to its peak magnitude each half cycle, the voltage tends to cause a flash-over as the voltage approaches its maximum magnitude each half cycle. Each time the current flashes over as the arc gap widens on the opening stroke, the flash-over occurs as a higher voltage. For this reason, the basic design criterion of the drive unit 30, which is suitable for use at 38 kV without the flash-over limiting technology of the present invention, is to accelerate the contactors of the circuit interrupter 10 sufficiently to prevent a flash-over from occurring after the initial current zero-crossing during the opening stroke. On the closing stroke, the contactor is designed conduct an arc for at most one-half of the power cycle, which is 50 Hertz or 60 Hertz depending on the location.

FIG. 2 is a functional block diagram of the electric power switch 8 operated as a switch for the reactor 26. Although the electric power switch is typically a three-phase device, only one phase is shown in FIG. 2 for descriptive convenience. The electric power switch 8 includes a penetrating circuit interrupter 10 driven by an interrupter control unit 20, as introduced with reference to FIG. 1. The interrupter control unit 20 includes an interrupter drive unit 30 and a mechanical interrupter linkage 40 that transmits motion of the drive unit to the internal contactor of the circuit interrupter 10. For the configuration shown in FIG. 1, the interrupter drive unit 30 generates accelerated lateral movement (horizontal with the switch oriented as shown in FIG. 1) of a connector at the end of a main shaft, which the interrupter linkage 40 translates into lateral motion (vertical with the switch oriented as shown in FIG. 1) of the contactor inside the circuit interrupter 10. For this configuration, the interrupter linkage 40 may be a relatively simple mechanical rocker arm assembly. Of course, gear boxes or other more complex linkages may be employed. Nevertheless, the ability to utilize a relatively simple mechanical rocker arm assembly produces advantages in cost, weight and reliability.

The circuit interrupter 10 is designed to be operated as part of an electric power system forming a large number of electric power circuits, which are represented schematically in FIG. 2 by an electric power source 21 feeding a generation-side electric power line 22, which feeds an electric power bus 23, which is typically located in a substation. The electric power bus 23, in turn, feeds a load-side power line 24 that provides electric power service to a number of loads represented by the load 25. The circuit interrupter 10 switches an electric service component, in this example the reactor 26, into and out of electrical communication with the electric power bus 23. Although the reactor 26 is shown in FIG. 2 in a configuration in which it can be selectively connected in parallel with the electric power circuit (i.e., between ground and the electric power bus), it could alternatively be connected in series with the power line or in any other circuit configuration suitable for a particular application. It should be appreciated that the electric power switch as shown in FIGS. 1 and 2 is specifically designed for operation in and electric power substation. Nevertheless, the electric power switch could be located near a generator, load or other electric service component, which may be operated by the electric utility or another party. For example, the switch could be located on customer premises, for example in association with an on-site generator or load center, or in any other location where high voltage electric power switching is required. In addition, the electric power switch is specifically designed to switch a reactor but can also be use to switch any type of electric service component, such as a capacitor bank, generation station, sectionalizing switch, load center, and so forth.

As noted above, the interrupter control unit 20 includes an interrupter drive unit 30 and a mechanical interrupter linkage 40 that transmits motion of the drive unit to the circuit interrupter 10. The drive unit 30 includes a linear arrangement with a bi-directional toggle mechanism located between a close latch 36 (also referred to as the closing latch) and an open latch 38 (also referred to as the closing latch). The toggle mechanism is typically operated by a motor 34, which can be controlled locally, remotely or automatically. The linear configuration of the drive unit, with the latches spaced apart from the toggle mechanism, produces significant advantages for the drive unit. These advantages generally include a simpler, less expensive and more reliable electric power switch that is designed to achieve a higher number of switching operations than prior switch configurations designed for the similar applications.

FIG. 3 is a rear view of the limited flash-over electric power switch 8 showing the internal components of the interrupter control unit 20, which includes the interrupter drive unit 30 and the mechanical interrupter linkage 40. The interrupter drive unit 30 includes the bi-directional toggle mechanism 32 located between the close latch 36 (located to the right of the toggle mechanism in the rear view of FIG. 3) and the open latch 38 (located to the left of the toggle mechanism in the rear view of FIG. 3). The motor 34 drives the bi-directional toggle mechanism as described in detail with reference to the following figures. A connector 35 on the end of a main shaft driven by the interrupter drive unit 30 connects the drive unit to the interrupter linkage 40. The connector 35 moves laterally (horizontally left and right as shown in FIG. 3), and the interrupter linkage 40 translates that motion to lateral movement of the circuit interrupter 10 (vertically up and down as shown in FIG. 3). Having described the interrupter drive unit sufficiently for the purpose of the present invention, it will not be further described here. As noted previously, the drive unit is further described in U.S. application Ser. No. 11/944,111, which is incorporated by reference.

Figure 4:
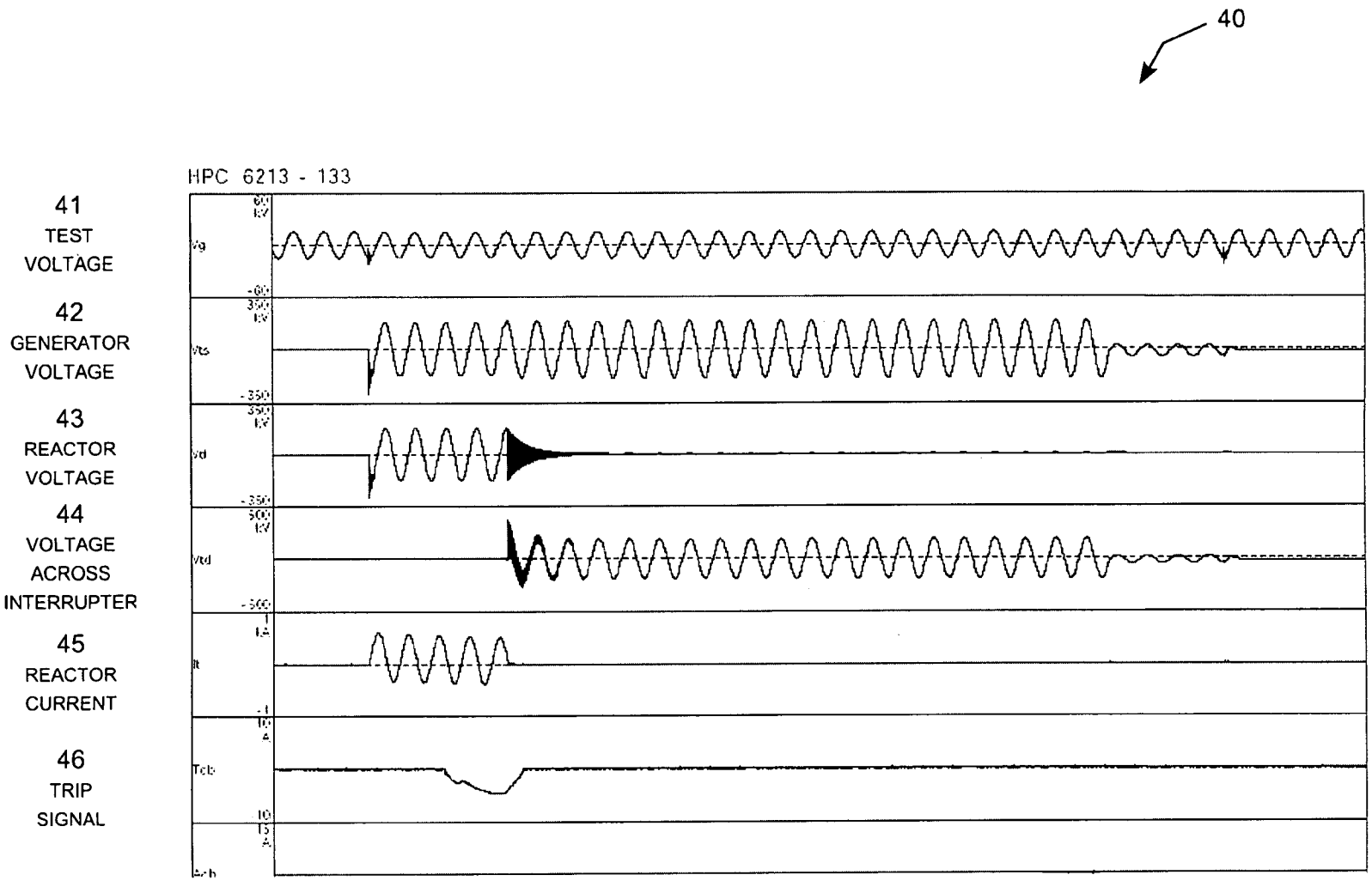
FIG. 4 is set of graphs illustrating a reactor switching operation without a flash-over.
Figure 5:
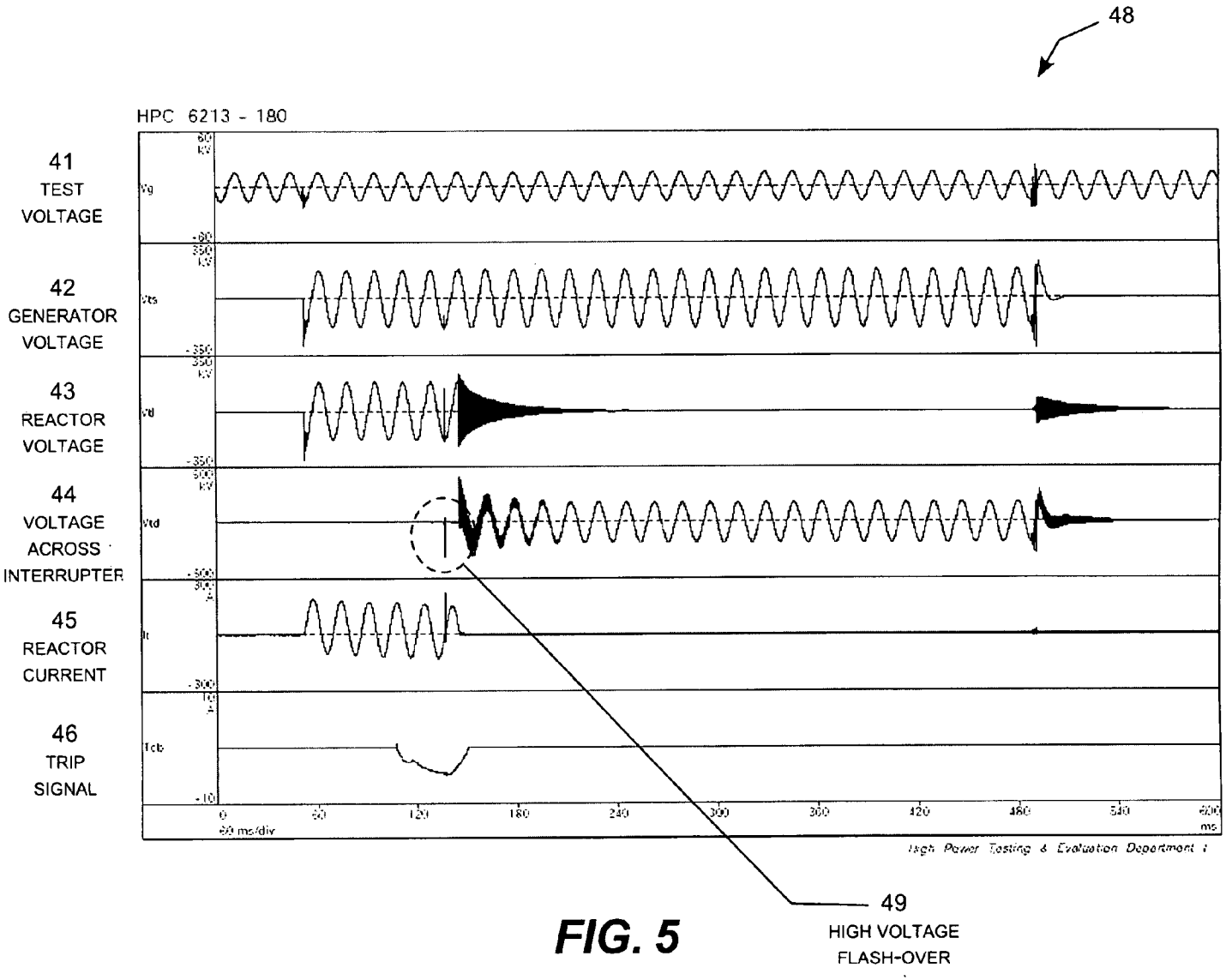
FIG. 5 is set of graphs illustrating a reactor switching operation with a flash-over.

FIG. 4 is set of graphs 40 illustrating a reactor switching operation without a flash-over. In descending order from the top of the illustration, the graph 41 shows a test voltage, the graph 42 shows the voltage produced by a generator powering a reactor that is to be disconnected from the generator by a circuit interrupter, the graph 43 shows the voltage across the reactor, the graph 44 shows the voltage across the interrupter contacts, the graph 45 shoes the reactor current, and the graph 46 shows the trip signal initiating the operation of the circuit interrupter to disconnect the reactor from the generator. There is no flash-over in this switching operation, which is the desired result of the limited flash-over electric power switch 8. FIG. 5 is a set of graphs 48 showing the same set of graphs 41-46 shown in FIG. 4, except in this case the reactor switching operation incurs a high voltage flash-over 49 shown in the graph 44 of the voltage across the interrupter contacts. The limited flash-over electric power switch is designed to avoid extremely steep nature of the voltage rise caused by the voltage flash-over.

Figure 6:
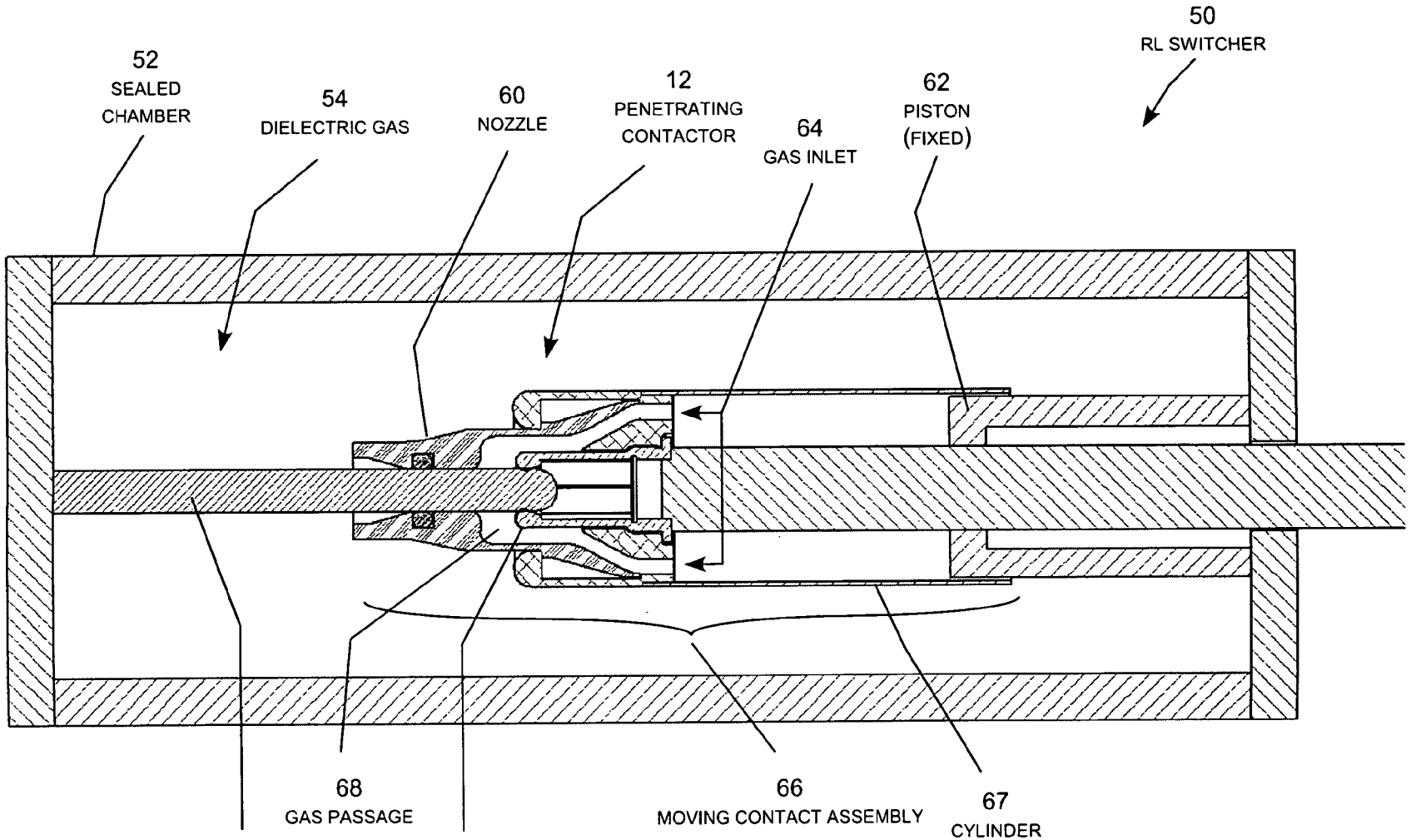
FIG. 6 is a side cross-sectional view of an RL switcher of the limited flash-over electric power switch in its closed position.
Figure 7:
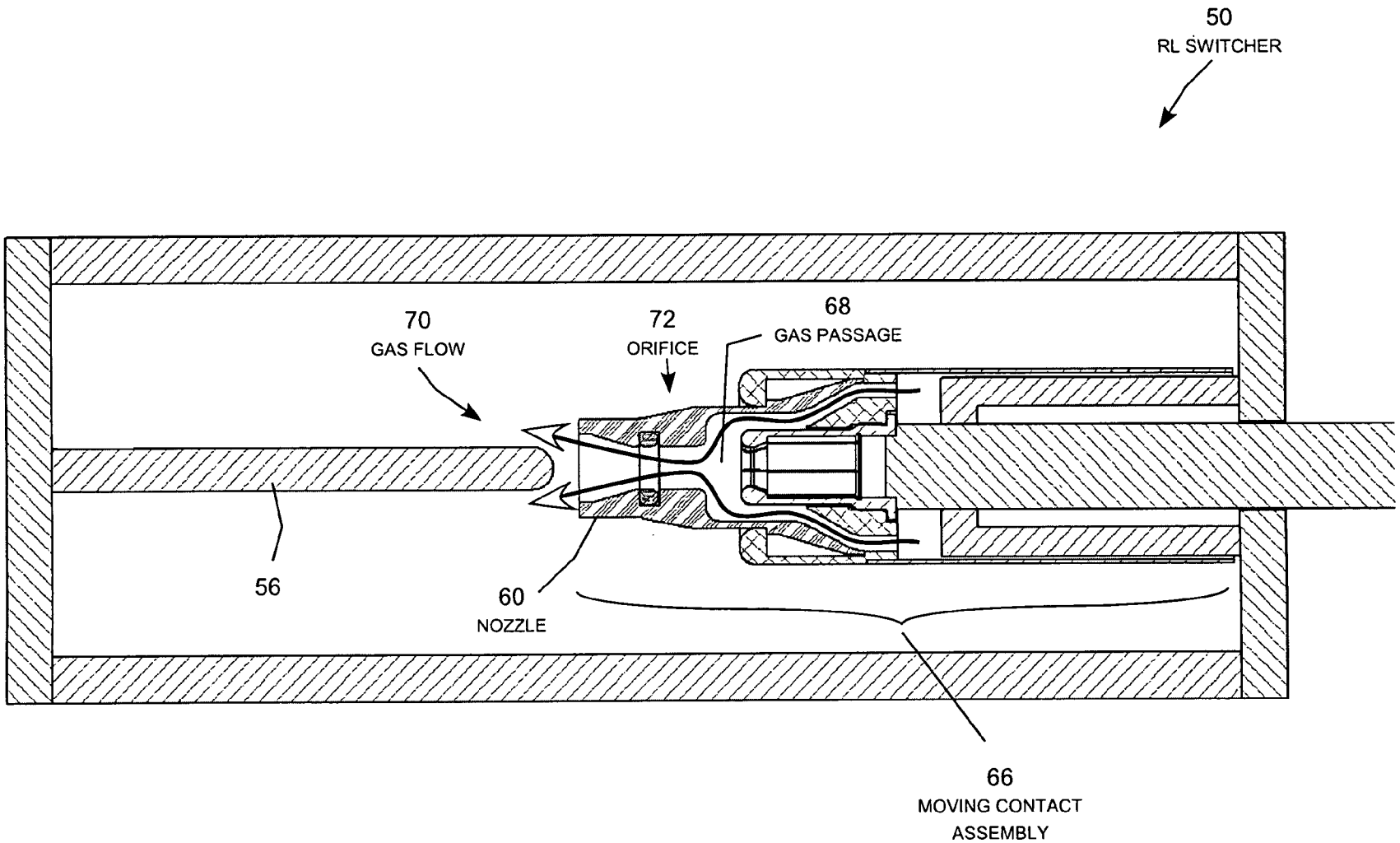
FIG. 7 is a side cross-sectional view of the RL switcher in its open position.

FIG. 6 is a side cross-sectional view of a reactive load or RL switcher 50 of the limited flash-over electric power switch in its closed position and FIG. 7 shows the RL switcher in its open position. The RL switcher 50 refers to the penetrating contactor 12 and associated components, including the flash-over limiting features of the present invention, located inside the sealed chamber 52, which is filled with a dielectric gas 54. Referring to FIGS. 1-3, in a preferred embodiment an RL switcher 50 is located inside each of the circuit interrupters 10*a-c*, which are commonly operated by the interrupter control unit 20 and interrupter drive unit 30. The penetrating contactor 12 includes a male contact 56, which is fixed in relation to the chamber 52, and a female contact 58 that moves in relation to the male contact. The female contact 58 is surrounded by a nozzle 60, which form part of a moving contact assembly 66. The moving contact assembly 66 defines a cylinder 67 that is received on a piston 62 to form a pump for the dielectric gas 54. That is, as the interrupter drive unit translates the moving contact assembly 66 to open the contacts (i.e., the interrupter drive unit forces the moving contact assembly to the right as shown in the transition from FIG. 6 to FIG. 7), the cylinder 67 slides over the piston 62, which drives the dielectric gas inside the cylinder through the gas inlet 64 and through the gas passage 68 into the nozzle 60.

In a conventional interrupter, the dielectric gas 54 would begin to flow through the gas passage 68 and into the nozzle 60 immediately upon movement of the moving contact assembly 66. In the RL switcher 50, however, the presence of the male contactor 56 in an orifice 72 defined by the nozzle 60 prevents the dielectric gas from flowing, and builds up gas pressure inside the cylinder 67 gas passage 68, until the orifice clears the end of the orifice allowing the gas flow 70 to exit the nozzle 60.

Figure 8:
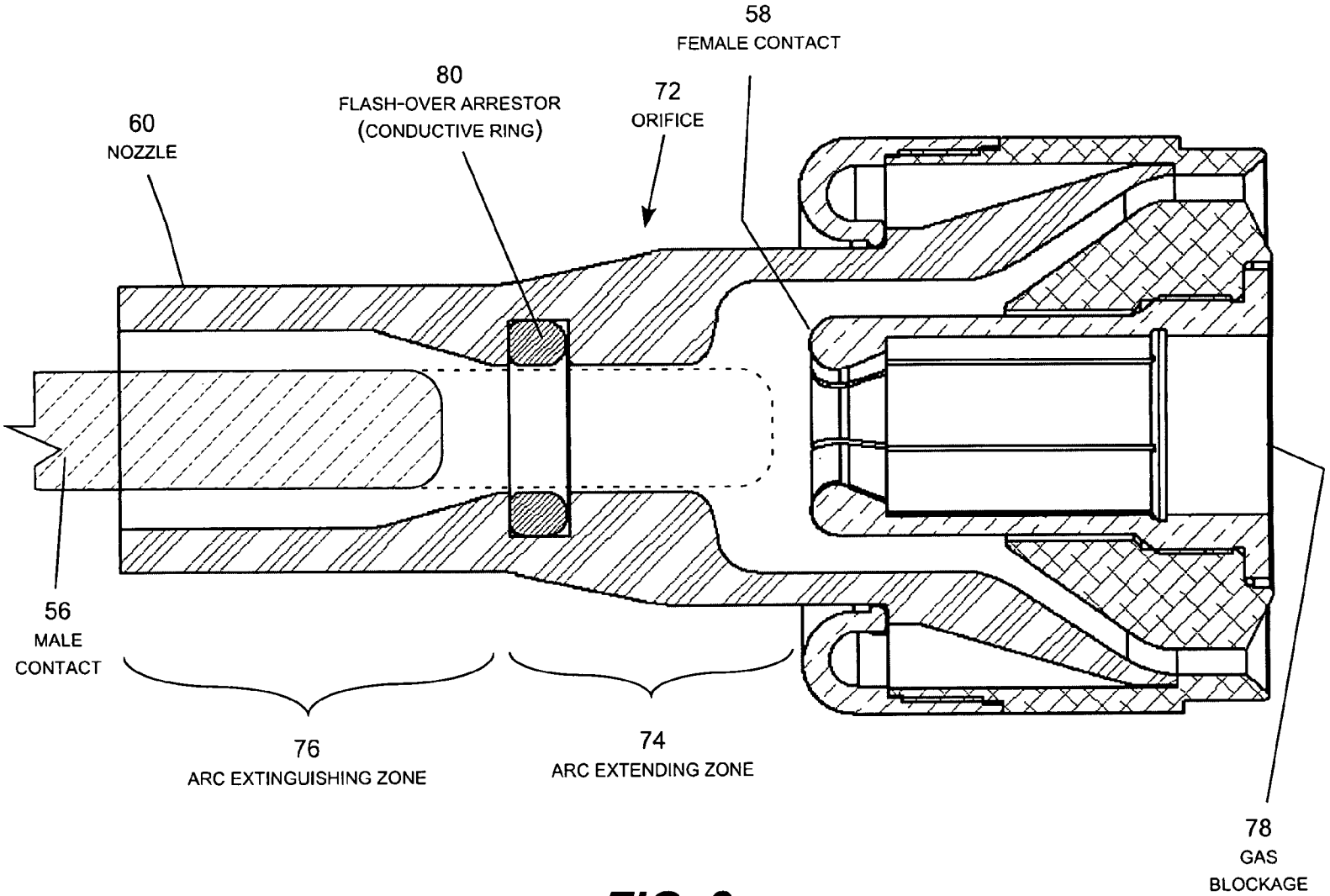
FIG. 8 is a side cross-sectional view of a nozzle and female contact of the RL switcher.

FIG. 8 is a side cross-sectional view of the nozzle 60 and the female contact 58 of the RL switcher 50 showing the flash-over limiting features of the nozzle in greater detail. As the interrupter opens, the nozzle 60 moves with respect to the male contact 56. The nozzle includes an orifice 72 that is sized to closely fit the outer diameter of the male contact 56, as shown in dashed lines in FIG. 8. The region of the nozzle from the outer end (i.e., the end to the left as shown in FIG. 8) of the female contact 58 to the outer end of the orifice 72 forms an arc extension zone 74. Following the arc extension zone, the nozzle includes an arc extinguishing zone 78, which includes a flared section enlarging the internal diameter of the nozzle so that the dielectric gas can flow past the end of the male contact when the end of the nozzle enters into the arc extinguishing zone. The male contact 56 in this position is shown in dashed lines in FIG. 8. The nozzle may also include a gas blockage 78 at the rear of the female contactor 58 to ensure that the dielectric gas does not escape from the nozzle as the dielectric gas is compressed by the piston.

To further suppress high voltage flash-over after the flow of dielectric gas has been introduced into the arc gap, the nozzle 60 includes an additional flash-over arrestor 80 that snubs out incipient flash-over that may occur as the arc attempts to reform across the arc gap. The flash-over arrestor 80 is preferably a conductive ring located on the interior surface of the nozzle 60 in the region of the orifice 72. The conductive ring is exposed to the interior volume of the nozzle, where it intercepts and spreads out an incipient flash-over that is attempting to propagate along the interior nozzle surface. The combination of the dielectric gas regulator formed by the male contactor 56 and the orifice 72 and the flash-over arrestor 80, which can both be incorporated into the nozzle design, greatly reduces the occurrence of high voltage flash-over within the circuit interrupter.

Figure 9:
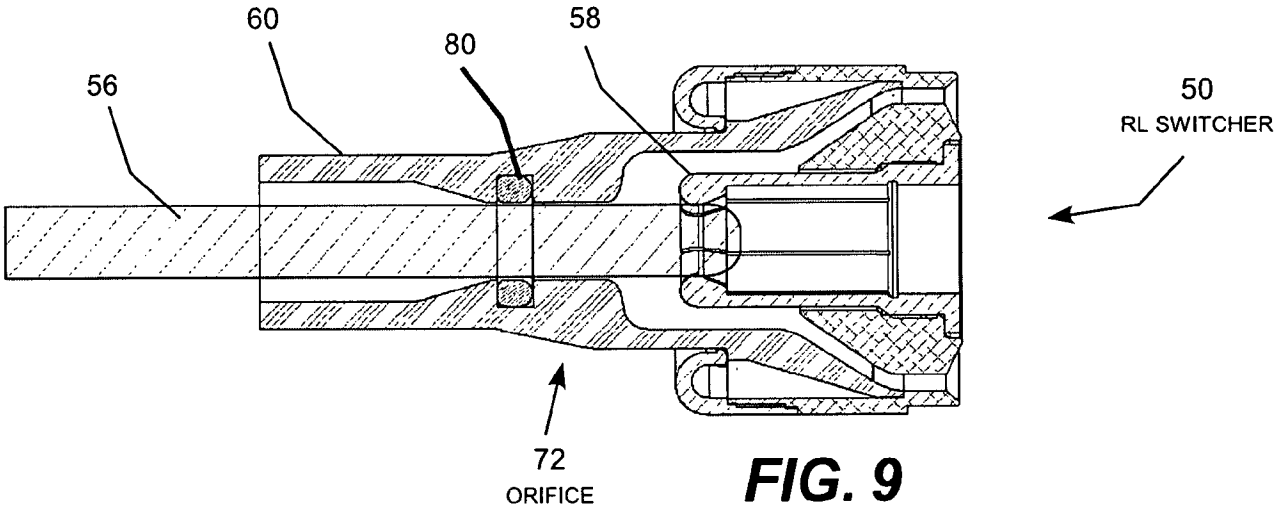
FIG. 9 is a side cross-sectional view of the RL switcher in a closed position.
Figure 10:
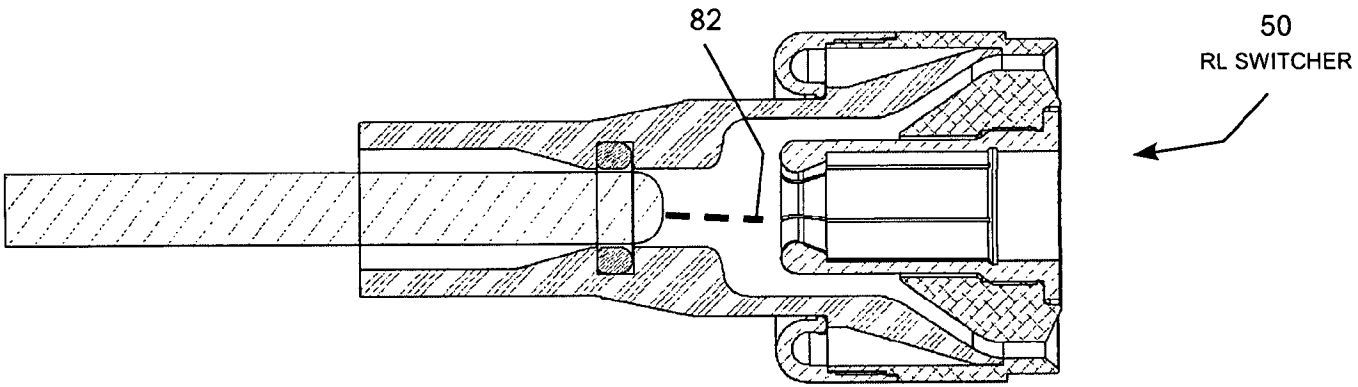
FIG. 10 is a side cross-sectional view of the RL switcher in a first partially open position.
Figure 11:
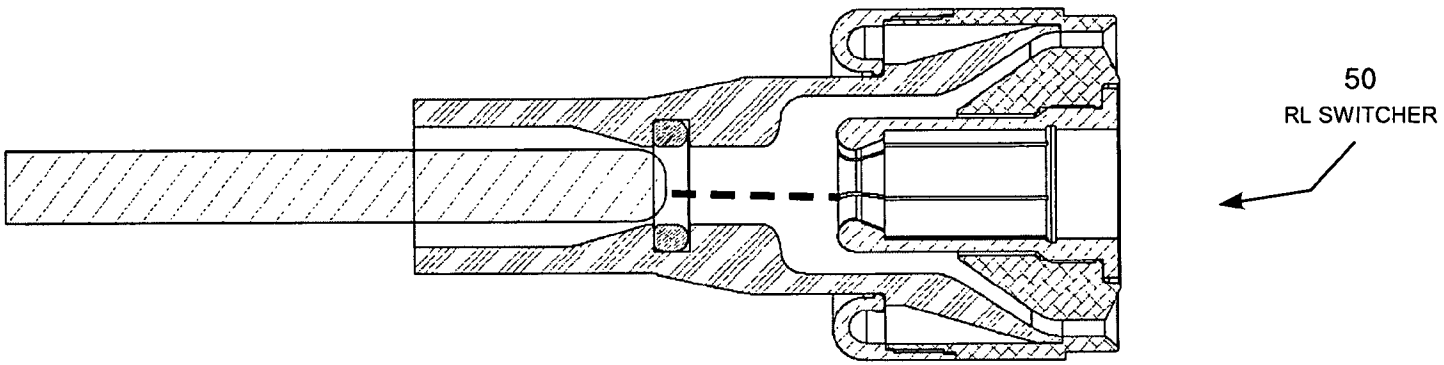
FIG. 11 is a side cross-sectional view of the RL switcher in a second partially open position.
Figure 12:
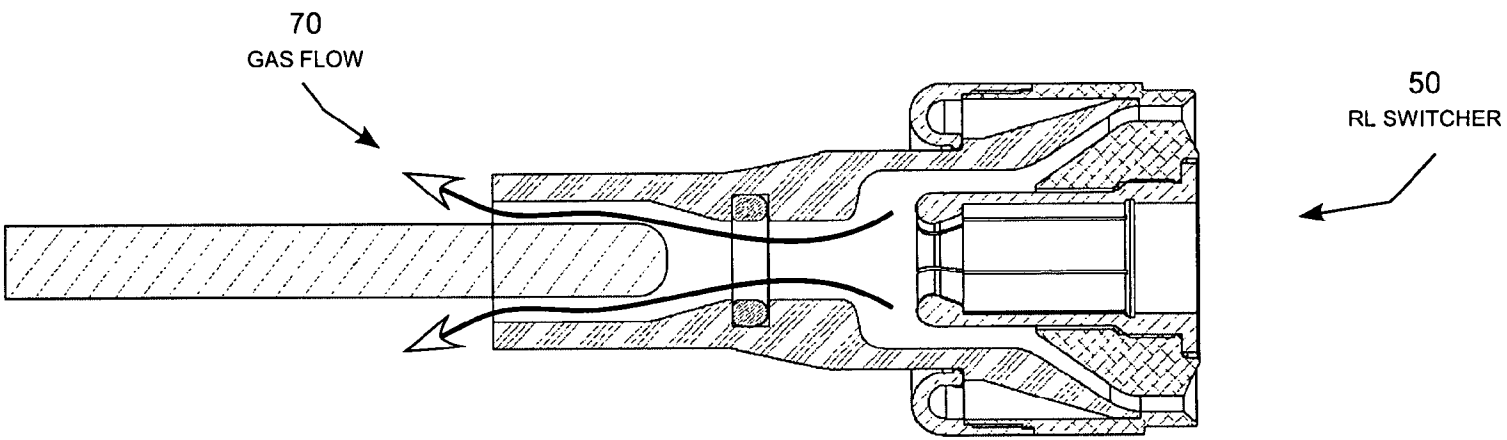
FIG. 12 is a side cross-sectional view of the RL switcher in a third partially open position.
Figure 13:
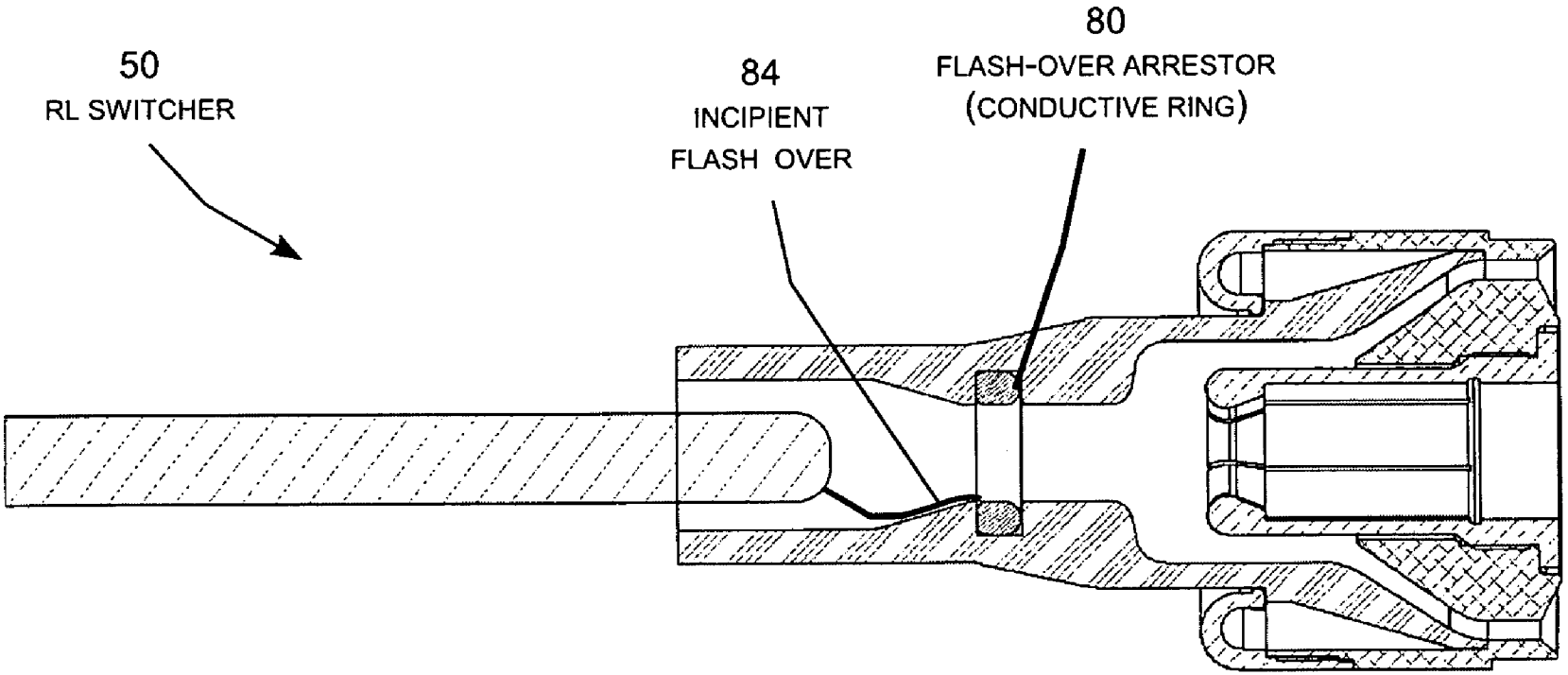
FIG. 13 is a side cross-sectional view of the RL switcher in a partially open position illustrating the operation of a flash-over arrestor.

FIGS. 9-13 are a series of drawings illustrating the opening stroke of the RL switcher 50. FIG. 9 shows the RL switcher 50 in the closed position in which the male contact 56 is in physical contact with the female contact 58. As shown in FIG. 10, as the contacts separate during the initial portion of the opening stroke, an arc 82 forms between the male contact 56 and the female contact 58. Until the orifice 72 moves past the end of the male contact 56, the presence of the male contact in the orifice prevents the dielectric gas from flowing through the nozzle 60 and causes gas pressure to increase inside the arc extension zone 74 of the nozzle (shown in FIG. 8). FIG. 11 illustrates the point where the orifice 72 starts to move past the end of the male contact 56. FIG. 12 illustrates a point where the orifice 72 has moved past the end of the male contact and the gas flow 70 begins to flow through the nozzle. FIG. 13 illustrates a point where an incipient flash-over 84 attempts to propagate along the inner surface of the nozzle but is snubbed out by the flash-over arrestor 80.

Figure 14:
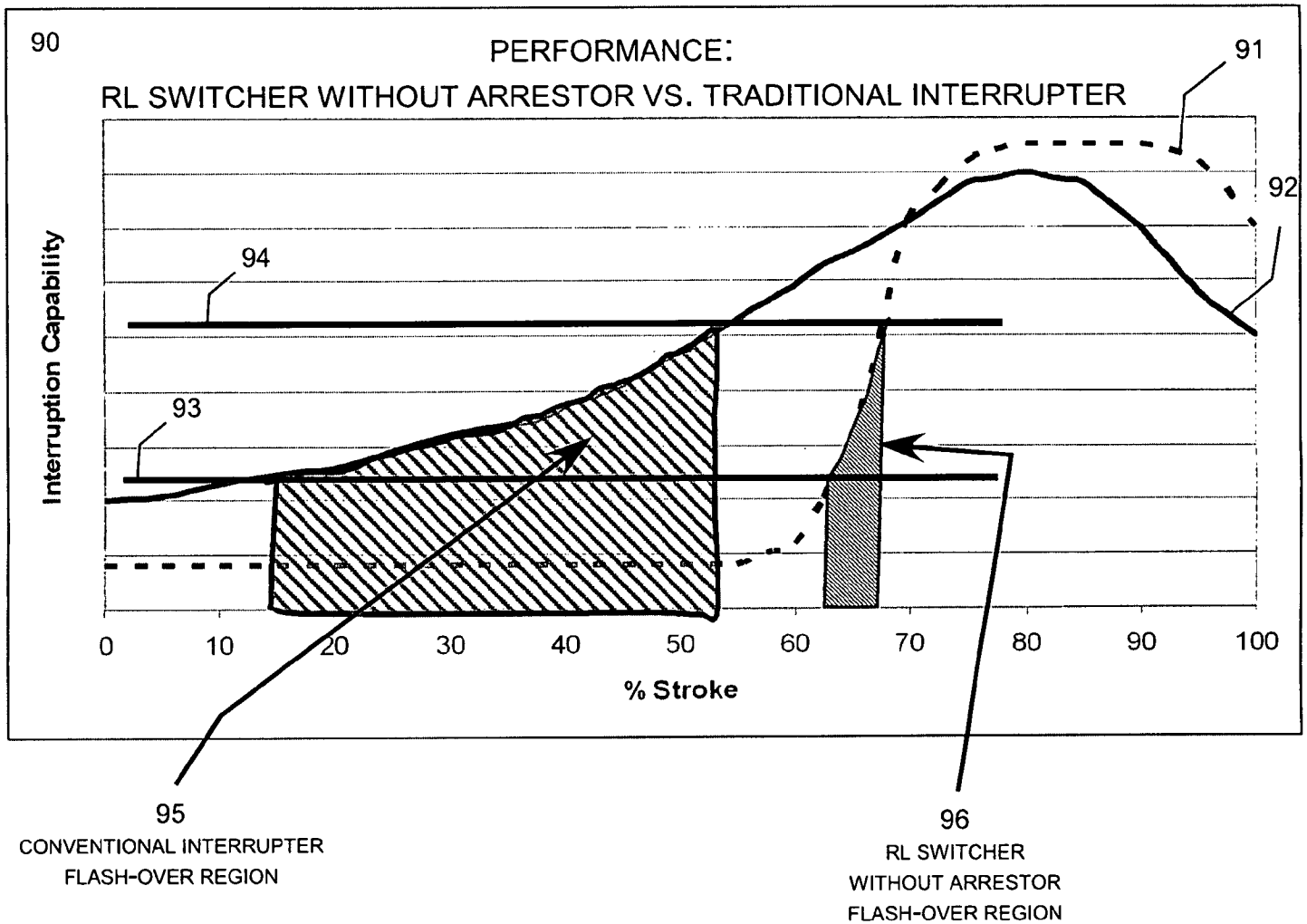
FIG. 14 is a graph comparing the performance of the RL switcher without a flash over arrestor to a conventional circuit interrupter.

FIG. 14 is a graph 90 comparing the performance of the RL switcher without a flash over arrestor to a conventional circuit interrupter. The line 91 represents the breakdown voltage between the interrupter contacts of the RL switcher and line 92 represents the breakdown voltage between the interrupter contacts of the conventional circuit interrupter as a function of the percent of the opening stroke. The line 93 represents the point at which the contactor in the presence of a flow of the dielectric gas begins to extinguish the arc at a current zero-crossing with flash-over and line 94 represents the point at which the contactor in the presence of a flow of the dielectric begins to extinguish the arc without flash-over. Therefore, between the lines 93 and 94 occurring under a breakdown voltage curve for a particular interrupter represents the region in which flash-over occurs for that interrupter. Specifically, the region 95 under breakdown voltage curve 92 for the conventional circuit interrupter between the lines 93 and 94 represents the "flash-over region" where flash-over occurs for the conventional interrupter. Similarly, the region 96 under breakdown voltage curve 91 for the conventional circuit interrupter between the lines 93 and 94 represents the flash-over region where flash-over occurs for the RL switcher. As shown in FIG. 14, the conventional circuit interrupter enters its flash-over region 95 at about 15% of the opening stroke, whereas the RL switcher enters the its flash-over region 96 at about 63% of the opening stroke. This is due to the delayed entry of the flow of the dielectric gas into the arc gap in the RL switcher until about 55% of the opening stroke. Introduction of the dielectric gas flow at this point causes the steep rise in the breakdown voltage curve 91 after 55% of the opening stroke. The flash-over region 96 for the RL switcher is much smaller and narrower than the flash-over region 95 for the conventional interrupter.

Figure 15:
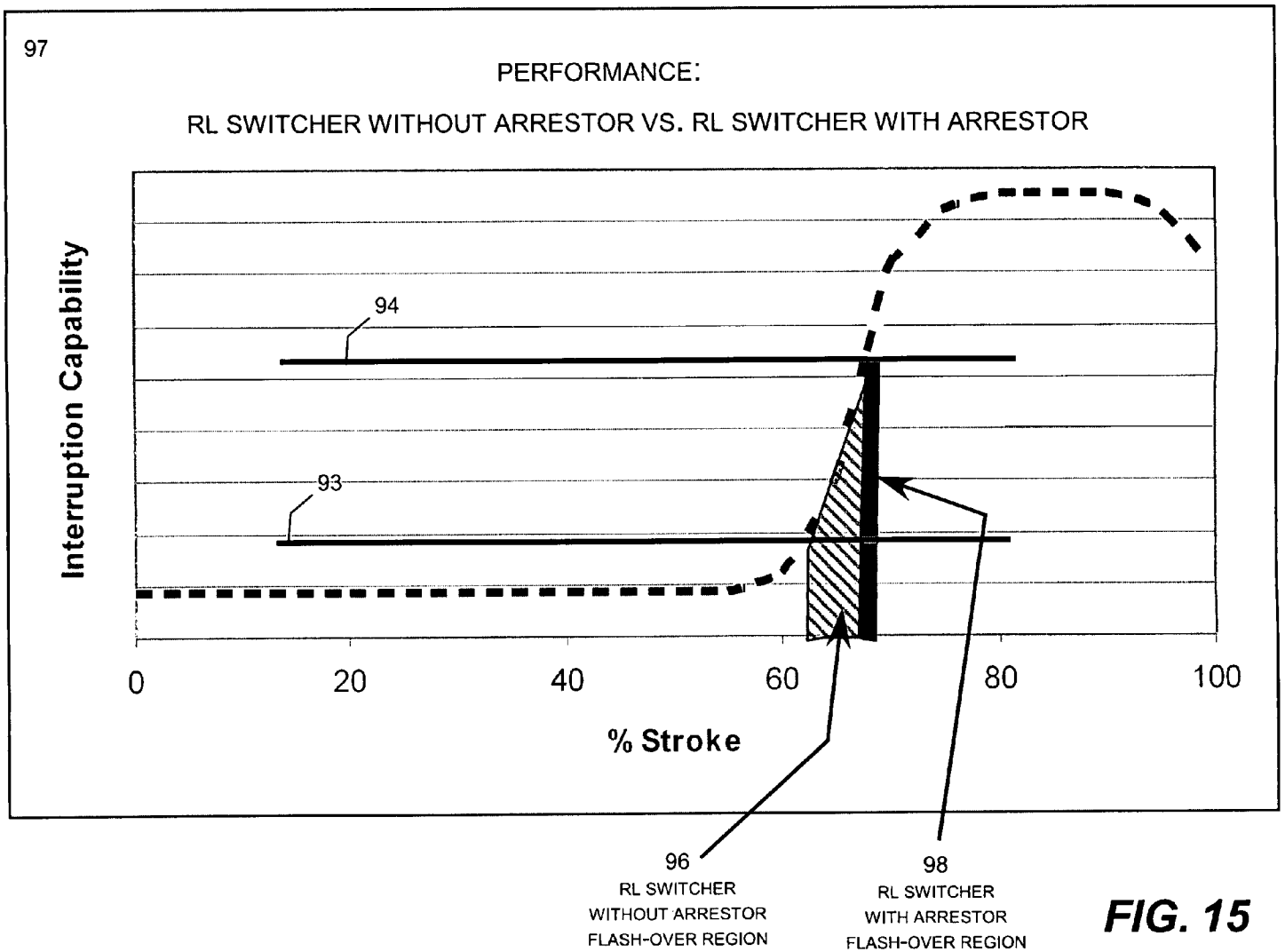
FIG. 15 is a graph comparing the performance of the RL switcher without a flash over arrestor to an RL switcher with a flash over arrestor.

FIG. 15 is a graph 97 comparing the performance of the RL switcher without a flash over arrestor to an RL switcher with a flash over arrestor. The flash-over region 96 for the RL switcher without a flash-over arrestor described with reference to FIG. 14 is reproduced on FIG. 15 along with the flash-over region 98 for the RL switcher with a flash-over arrestor. As shown in FIG. 15, the flash-over arrestor makes the flash-over region 98 smaller and narrower than the flash-over region 96.

Figure 16:
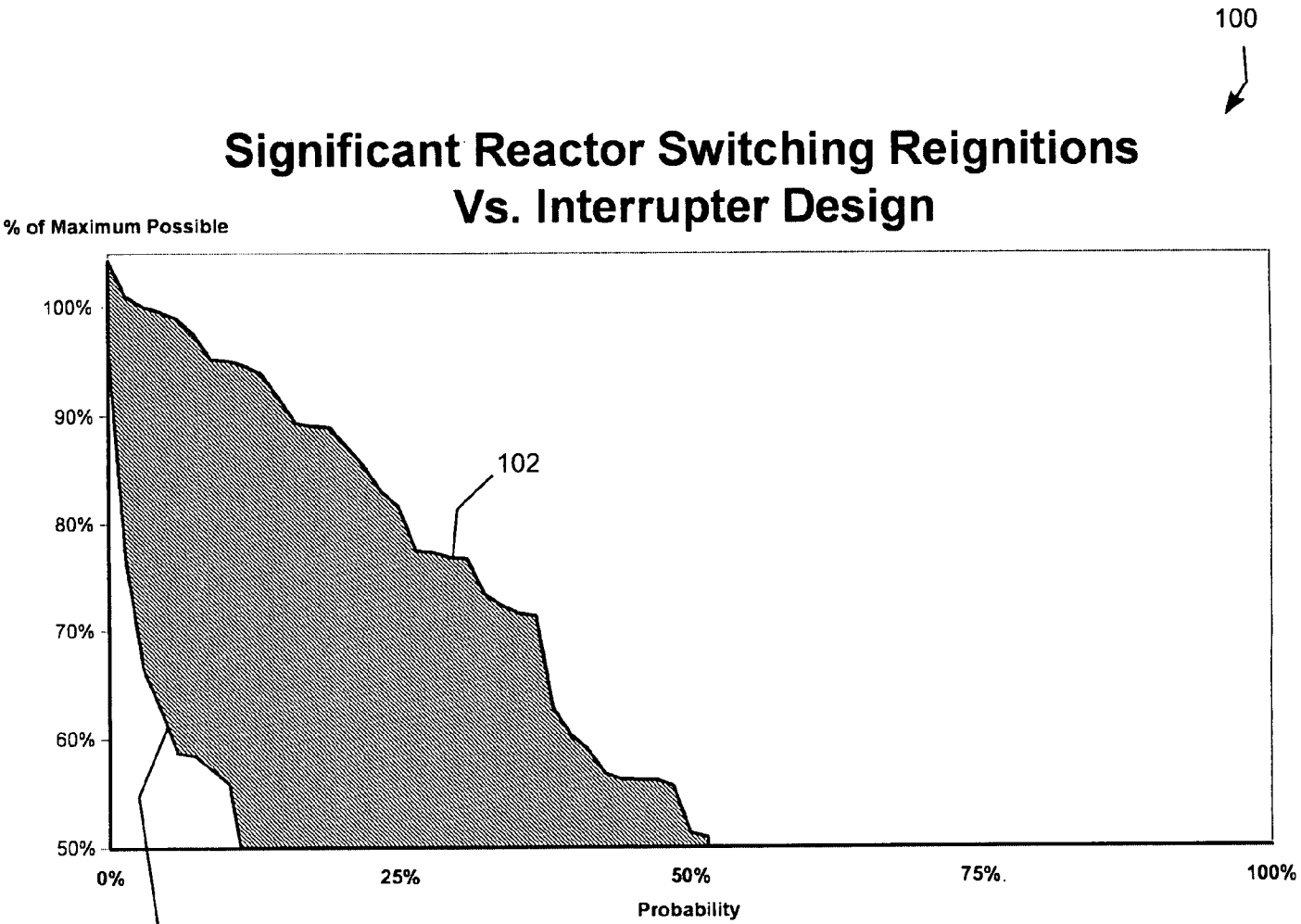
FIG. 16 is a graph illustrating the reduction in reignitions achieved by the limited flash-over electric power switch operated as a reactor switch.

FIG. 16 is a graph 100 illustrating the reduction in flash-over achieved by the limited flash-over electric power switch operated as a reactor switch. The area under the curve 102 represents the flash-over probability for a conventional interrupter, while the area under the curve 104 represents the flash-over probability for an RL switcher with a flash-over arrestor. As shown in FIG. 16, the present invention greatly diminishes the likelihood of a flash-over. It should be appreciated that there is some probability of a flash-over occurring even with an RL switcher because the timing of switch operation with respect to a current zero-crossing is assumed to be probabilistic for the purpose of FIG. 16. The probability of a flash-over occurring can be brought closet to zero or eliminated by precisely timing the operation of the interrupter with the current zero-crossing.

Figure 17:
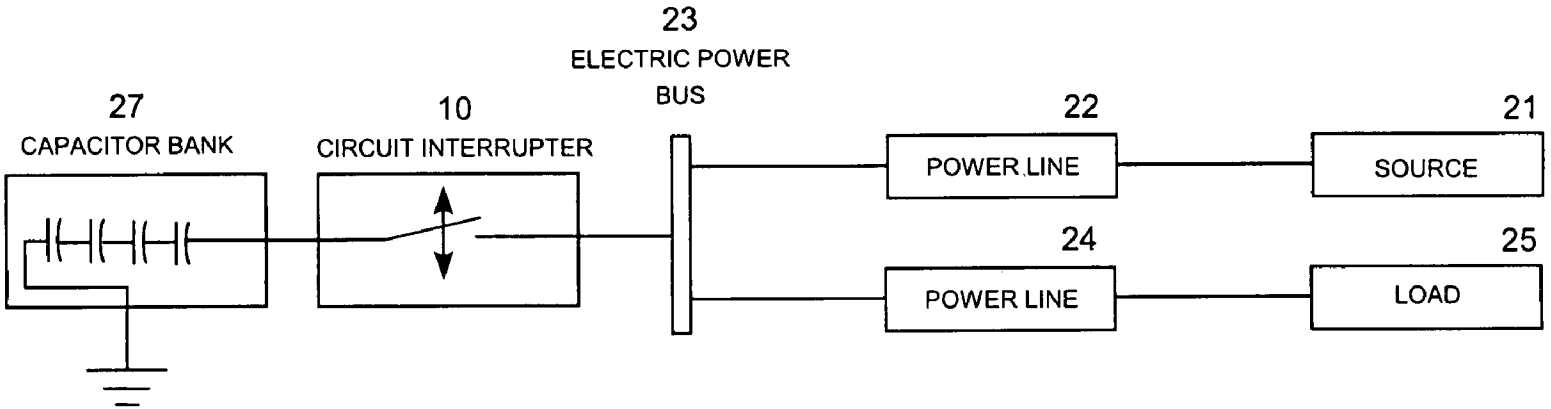
FIG. 17 is a functional block diagram of the limited flash-over electric power switch operated as a capacitor switch.
Figure 18:
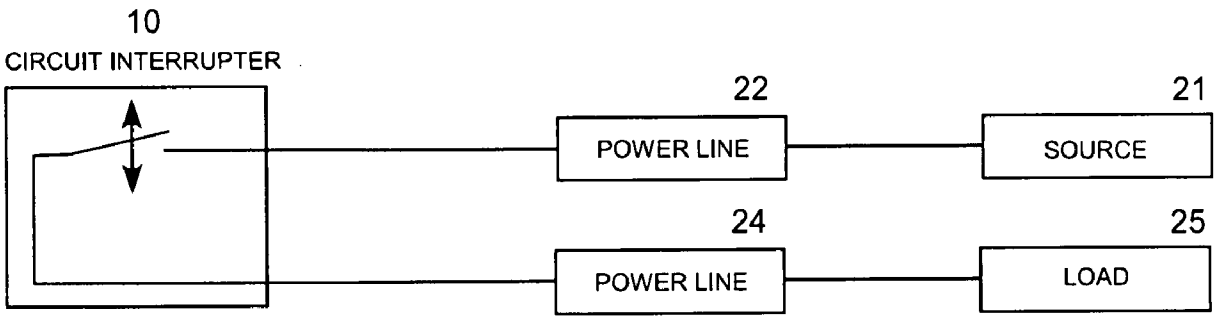
FIG. 18 is a functional block diagram of the limited flash-over electric power switch operated as a load or line switch.

FIG. 17 is a functional block diagram of an illustrative circuit interrupter 10 including an RL switcher used to switch a capacitor bank 27, and FIG. 18 is a functional block diagram of the circuit interrupter 10 operated as a load or line switch. Of course, any of the circuit interrupter 10 is typically motorized and may be operated locally or remotely, as desired.

In view of the foregoing, it will be appreciated that present invention provides significant improvements in circuit interrupters for distribution and transmission circuits up to high voltage and extra high voltage levels. The foregoing relates only to the exemplary embodiments of the present invention, and that numerous changes may be made therein without departing from the spirit and scope of the invention as defined by the following claims.

The invention claimed is:

1. A circuit interrupter configured to be electrically connected in an electric power circuit; comprising:

a sealed chamber containing a dielectric gas;

a contactor located within the chamber having first and second contacts movable in relation to each other during an opening stroke from a closed position in which the contacts are configured to be electrically connected to close the electric power circuit to an open position in which the contacts are configured to be electrically separated to open the electric power circuit;

a drive mechanism operable for moving the contacts through the opening stroke and creating a flow of the dielectric gas within the chamber to open the electric power circuit;

the contacts configured to form an arc extending in an arc gap direction across an arc gap between the contacts during the opening stroke;

a nozzle configured to direct the flow of the dielectric gas into the arc gap to extinguish the arc during the opening stroke, the nozzle comprising an arc extending zone in fluid communication with an arc extinguishing zone;

a dielectric gas regulator operable for restricting the flow of the dielectric gas into the arc gap during a first portion of the opening stroke to cause the arc gap to extend across the arc extending zone;

the dielectric gas regulator further operable for unrestricting the flow of the dielectric gas into the arc gap during a second portion of the opening stroke to initially extinguish the arc after the arc has extended across the arc extending zone and into the arc extinguishing zone; and the arc extending zone having a sufficient length in the arc gap direction to prevent the arc from flashing over across the arc gap between the contacts after the arc has been initially extinguished.

2. The circuit interrupter of claim 1, wherein:

the nozzle further comprises an orifice for controlling the flow of the dielectric gas into the arc gap;

the circuit interrupter further comprises a shaft movable into and out of the orifice; and the dielectric gas regulator comprises the shaft being received within the orifice during the first portion of the opening stroke and the shaft being removed from the orifice during the second portion of the opening stroke.

3. The circuit interrupter of claim 2, wherein:

the orifice is in contiguous fluid communication with the arc extending zone in the arc gap direction; and the first contactor comprises the shaft, which defines an end that moves through the orifice during the opening stroke.

4. The circuit interrupter of claim 3, wherein the arc extinguishing zone comprises the orifice.

5. The circuit interrupter of claim 4, wherein:

during the opening stroke, the end of the first contact moves relative to the second contact and the nozzle from a first position in physical contact with the second contact, then through the arc extending zone, then through the orifice which forms a first part of the arc extinguishing zone, and then through the arc extinguishing zone;

the first contact substantially restricts the flow of the dielectric gas into the arc gap until the end of the first contact moves through the orifice;

the arc extends between the first and second contacts within the arc extending zone until the end of the first contact moves through the orifice; and the end of the first contact moving through the orifice allows the dielectric gas to flow into the arc gap to extinguish the arc gap.

6. The circuit interrupter of claim 1, wherein:

the contactor is a penetrating-type contactor, the first contact defines a male contact that is fixed with relation to the chamber, and the second contact defines a female contact that is movable with relation to the chamber; and the nozzle is fixed in relation to and moves along with the female contact.

7. The circuit interrupter of claim 1, further comprising a flash-over arrestor configured to snub out incipient flash-over after the arc has been initially extinguished.

8. The circuit interrupter of claim 7, wherein the flash-over arrestor comprises a conductive ring located in the nozzle having a portion of the conductive ring exposed to an interior volume of the nozzle.

9. The circuit interrupter of claim 8, wherein the flash-over arrestor is located in the orifice of the nozzle.

* * * * *